US012385279B2

(12) United States Patent
Schneider et al.

(10) Patent No.: US 12,385,279 B2
(45) Date of Patent: Aug. 12, 2025

(54) RACKABLE GATE KIT

(71) Applicant: Barrette Outdoor Living, Inc., Middleburg Heights, OH (US)

(72) Inventors: Christopher Michael Schneider, Linwood, NJ (US); Paige Barbara Moore, Absecon, NJ (US); Patrick Joseph Bertke, Mays Landing, NJ (US); Christopher Rolland Clark, Morristown, TN (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 260 days.

(21) Appl. No.: 17/978,196

(22) Filed: Oct. 31, 2022

(65) Prior Publication Data

US 2024/0141681 A1 May 2, 2024

(51) Int. Cl.
*E04H 17/14* (2006.01)

(52) U.S. Cl.
CPC ..... *E04H 17/1448* (2021.01)

(58) Field of Classification Search
CPC ..... E04H 17/1447; E04H 17/1488; E04H 17/1448; E04H 17/1456
USPC ..... 256/60, 67, DIG. 2
See application file for complete search history.

(56) References Cited

U.S. PATENT DOCUMENTS 4,813,651 A * 3/1989 Rutledge ..... E04H 17/1447 256/65.06
5,285,613 A * 2/1994 Goldsworthy ..... E04H 12/02 403/255
5,702,090 A * 12/1997 Edgman ..... E04H 17/1426 256/65.02
10,472,852 B2 * 11/2019 Rosario ..... E04H 17/1488
11,851,905 B2 * 12/2023 Niederkofler ..... E04H 17/1456
(Continued)

FOREIGN PATENT DOCUMENTS

KR 20110000285 U * 1/2011
KR 102423773 B1 * 7/2022 ..... E04H 17/1465

OTHER PUBLICATIONS

"Full Tilt Gate Kit", Nationwide Industries, Retrieved from https://nationwideindustries.com/product/full-tilt-gate-kit-aluminum/ Retrieved on: Oct. 31, 2022 (4 pages total).

*Primary Examiner* — Amber R Anderson
*Assistant Examiner* — Zachary A Hall
(74) *Attorney, Agent, or Firm* — John Maldjian, Esq.; Stevens & Lee PC

(57) ABSTRACT

Kits for assembling rackable gates are provided. The kits comprise a pair of gate uprights, each gate upright comprising a tubular elongate member and a bracket. The tubular elongate member comprises apertures configured to accept a fence panel rail therethrough and into an elongate channel situated on an interior surface therein and configured to securely receive an end of the fence panel rail such that lateral and torsional movement of said fence panel rail is restricted. The bracket comprises a pair of bracket arms attached to an exterior surface of the tubular elongate member, each situated directly opposite the other with an aperture situated therebetween and configured to accommodate a fastener for fastening a fence panel rail thereto. Also provided are methods for assembling gates from such kits and gates assembled from such kits and by such methods.

19 Claims, 10 Drawing Sheets

(56) References Cited

U.S. PATENT DOCUMENTS

| | | | | |
|---|---|---|---|---|
| 2012/0138758 | A1* | 6/2012 | Graber | E04H 17/1417<br>248/221.11 |
| 2021/0381271 | A1* | 12/2021 | Schneider | E04H 17/1456 |
| 2022/0356728 | A1* | 11/2022 | Ash | E04H 17/1448 |

* cited by examiner

RACKABLE GATE KIT

FIELD OF THE INVENTION

The present disclosure relates generally to rackable gate kits, methods of assembling gates from such kits, and gates assembled from such kits and by such methods.

BACKGROUND

Barriers, such as fences, are installed over a wide variety of terrain. On hilly or sloped terrain it is therefore often necessary to rack the barrier at an upward or downward angle to follow the grade of the terrain. In order to access fenced terrain, it may also be necessary to install one or more gates along the barrier. Thus, when terrain is hilly or sloped, it is therefore often necessary that the gate also be racked at an upward or downward angle to follow the grade of the terrain. However, because of the variability inherent in the terrains of different locales, such racked gates must typically be ordered from and custom fabricated by a barrier manufacturer.

Kits for fabricating racked gates from stock fence panels are commercially available. However, the process for fabricating racked gates from such kits is cumbersome. Furthermore, the racked gates fabricated from such kits leave much to be desired from a structural standpoint. For example, the rails of such racked gates tend to be quite loose relative to the gate upright. As such, the rails are prone to torquing, rattling, and other undesirable movements when in use.

Accordingly, there remains a continuing need for kits useful for easily fabricating structurally sound racked gates from stock fence panels.

SUMMARY

Such improved ease of fabrication and structural integrity is possessed by the rackable gate kits according to embodiments of the present invention. These and other advantages will be apparent from the present application of the embodiments described herein.

Embodiments of the present invention are directed to rackable gate kits. The kits comprise a pair of gate uprights, wherein each gate upright comprises a tubular elongate member and a bracket. The tubular elongate member comprises (1) a plurality of first apertures in alignment along a length of the tubular elongate member, wherein each of the plurality of first apertures is configured to accept insertion of a fence panel rail therethrough and into an interior space of the tubular elongate member and (2) an elongate channel situated on and extending a length of an interior surface of the tubular elongate member, wherein the elongate channel is situated directly opposite the plurality of first apertures and configured to securely receive an end of the fence panel rail such that lateral and torsional movement of the fence panel rail is restricted when received therein. The bracket comprises a pair of bracket arms attached to an exterior surface of the tubular elongate member, wherein each of the pair of bracket arms are situated directly opposite each other with one of the plurality of first apertures therebetween, and wherein each of the pair of brackets comprises at least one second aperture configured to accommodate a fastener for fastening a fence panel rail to the bracket.

In certain embodiments of the present invention, each of the gate uprights are formed from extruded aluminum. In certain other embodiments of the present invention, the horizontal cross-sectional shape of the tubular elongate member is square.

In certain embodiments of the present invention, each first aperture is formed via routing. In certain other embodiments of the present invention, each first aperture is square or rectangular in shape. In yet certain other embodiments of the present invention, each first aperture is further configured to accommodate an upwardly and/or downwardly racked fence panel rail. In yet certain other embodiments of the present invention, each tubular elongate member comprises three first apertures, wherein a top first aperture is situated proximal to a top end of the tubular elongate member, a bottom first aperture is situated proximal to a bottom end of the tubular elongate member, and an intermediate first aperture is situated intermediate to the top and bottom first apertures.

In certain embodiments of the present invention, the elongate channel is defined by a pair of planes extending longitudinally along the interior surface of the tubular elongate member and projecting inwardly into the interior space of the tubular elongate member. In certain other embodiments of the present invention, each of said pair of planes is angled away from the other. In yet certain other embodiments of the present invention, each tubular elongate member further comprises a plurality of pre-drilled holes, wherein each pre-drilled hole is situated and configured to accommodate a fastener for securing a fence panel rail to the tubular elongate member.

In certain embodiments of the present invention, each bracket arm comprises two second apertures each configured to accommodate a fastener for fastening a fence panel rail to the bracket. In certain other embodiments of the present invention, the pair of bracket arms are situated directly opposite each other with the intermediate first aperture therebetween.

In certain embodiments of the present invention, the kit further comprises one or more additional components selected from group consisting of: rail grippers, hinges, gate stops, latches, fasteners configured to secure a fence panel rail to the bracket, fasteners configured to secure a fence panel rail to the tubular elongate member, U-channel blocks, and post tops.

Embodiments of the present invention are directed to methods of assembling a gate. The methods comprise the steps of (1) providing a fence panel comprising a plurality of vertical pickets and a plurality of elongate rails extending transverse to said vertical pickets, each rail having a first end and a second end opposite the first end, (2) providing a rackable gate kit according to embodiments of the present invention, wherein each gate upright comprises at least as many of the first apertures as the plurality of elongate rails, and wherein spacing between the plurality of first apertures correspond to spacing between the plurality of elongate rails, (3) installing a first gate upright onto each of the first ends of the plurality of elongate rails by inserting each elongate rail through a corresponding first aperture of the first gate upright such that each first end is securely received into the elongate channel of the first gate upright, (4) securing the first gate upright to the fence panel by fastening the pair of bracket arms of the first gate upright to a fence panel rail situated therebetween with a fastener traversing the at least one second aperture of each bracket arm and the fence panel rail, (5) installing a second gate upright onto each of the second ends of the plurality of elongate rails by inserting each elongate rail through a corresponding first aperture of the second gate upright such that each second end is securely received into the elongate channel of the second gate upright, and (6) securing the second gate upright to the fence panel by fastening the pair of bracket arms of the second gate upright to a fence panel rail situated therebetween with a fastener traversing the at least one second aperture of each bracket arm and the elongate rail.

In certain embodiments of the present invention, the methods further comprise the step of installing a rail gripper between each bracket arm and the elongate rail situated therebetween prior to fastening the pair of bracket arms to the elongate rail. In certain other embodiments of the present invention, the methods further comprise the step of securing each of the plurality of elongate rails to the tubular elongate member of each gate upright by installing a fastener through each tubular elongate member and into each elongate rail. In yet certain other embodiments of the present invention, the methods further comprise the step of cutting the fence panel to fit a gate opening prior to installation of the pair of gate uprights thereon. In yet certain other embodiments of the present invention, the methods further comprise providing a straight fence panel.

In yet certain other embodiments of the present invention, the methods further comprise providing a racked fence panel.

Embodiments of the present invention are directed to gates assembled according to methods according to embodiments of the present invention.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

DETAILED DESCRIPTION

Figure 1A:
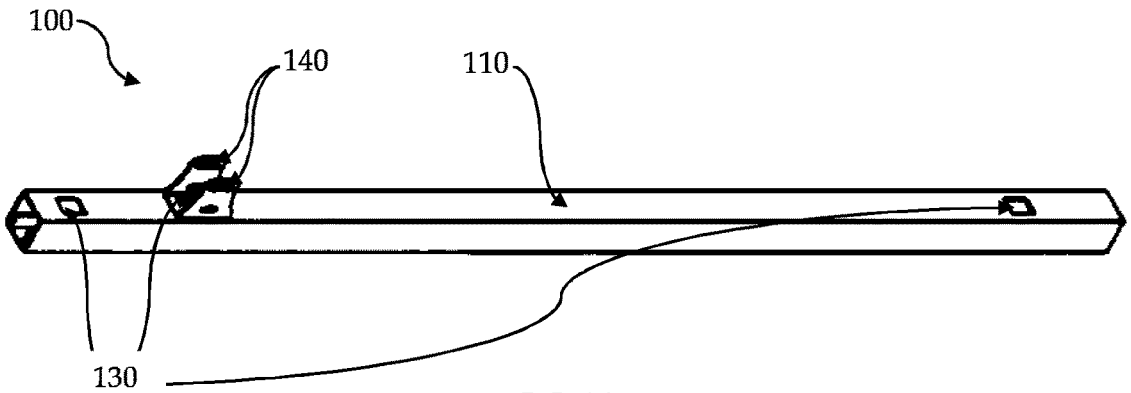
FIGS. 1A, 1B, and 1C illustrate perspective, side, and top views of a gate upright according to embodiments of the present invention disclosed herein.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including, but not limited to. To facilitate understanding, like reference numerals have been used, where possible, to designate like elements common to the figures.

The phrases "at least one", one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

An aspect of the present invention are kits for assembling rackable gates. In accordance with embodiments of the present invention, these kits comprise a pair of gate uprights. Each gate upright comprises a tubular elongate member and a bracket. The tubular elongate member comprises a plurality of first apertures in alignment along its length. Each of the plurality of first apertures is configured to accept insertion of a fence panel rail therethrough and into an interior space of the tubular elongate member.

The tubular elongate member further comprises an elongate channel situated on and extending a length of an interior surface of the tubular elongate member. The elongate channel is situated directly opposite the plurality of apertures and configured to securely receive an end of the inserted fence panel rail such that lateral and torsional movement of the fence panel rail is restricted when received therein. The bracket comprises a pair of bracket arms attached to an exterior surface of the tubular elongate member. Each of the pair of bracket arms are situated directly opposite the other with one of the first apertures situated therebetween. Each bracket arm comprises at least one second aperture configured to accommodate a fastener for fastening the inserted fence panel rail to the bracket.

Figure 1B:
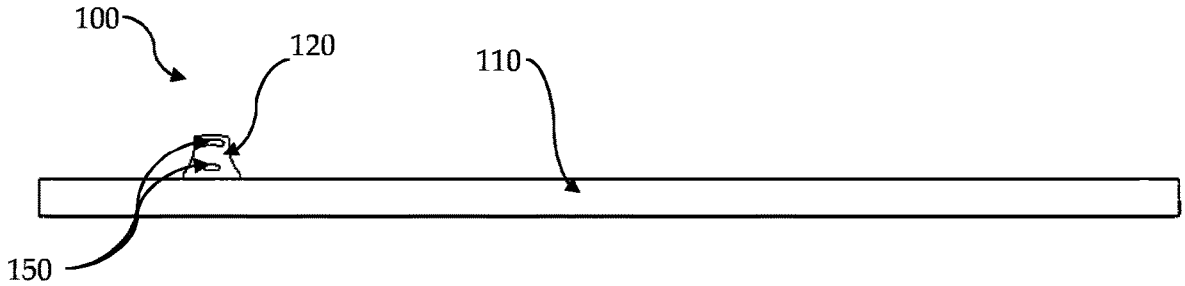
Figure 1C:
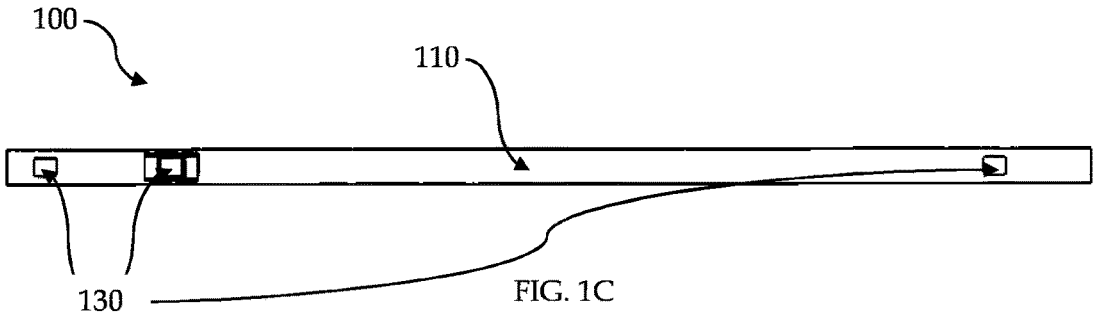

Referring to FIGS. 1A, 1B, and 1C, the gate upright 100 in accordance with embodiments of the present invention depicted therein comprises a tubular elongate member 110 and a bracket 120. While the horizontal cross-sectional shape of tubular elongate member 110 depicted therein is square, they may have any desired horizontal cross-sectional shape. Examples of such further horizontal cross-sectional shapes, include, but is not limited to, circular, oval, hexagonal, etc. In certain embodiments, the horizontal cross-sectional shape of tubular elongate member 110 matches that of the posts of the barrier system to which a gate assembled from gate uprights 100 will be mounted. Tubular elongate member 110 may be of any desired length and/or cross sectional area. In certain embodiments, tubular elongate member 110 is 56.5" in length. In certain embodiments, tubular elongate member 110 further comprises a plurality of pre-drilled holes each situated and configured to accommodate a fastener for securing a fence panel rail to an interior surface of the tubular elongate member.

According to embodiments of the present invention, tubular elongate member 110 comprises a plurality of first apertures 130 aligned along its length, each of which is configured to accept insertion of a fence panel rail therethrough and into an interior space of tubular elongate member 110. Referring to FIGS. 1A, 1B, and 1C, while depicted therein as rectangular in shape, first apertures 130 may be of any desired shape. Examples of such further shapes, include, but are not limited to, circular, square, etc. In certain embodiments, while each first aperture 130 is, at a minimum, configured to accommodate a straight fence panel rail, each may in certain other embodiments be further configured to accommodate an upwardly and/or a downwardly racked fence panel rail. In certain embodiments, such configurations for accommodating an upwardly and/or downwardly racked fence panel rail may be obtained by providing each first aperture 130 with a longitudinal dimension greater than the vertical dimension of a fence panel rail such that that the fence panel rail will have sufficient clearance to be installed into gate upright 100 while racked upwardly or downwardly at a given angle. Referring to FIGS. 1A, 1B, and 1C, while depicted therein to have a total of three first apertures 130, tubular elongate member 110 may have any desired number of first apertures 130. In certain embodiments, tubular elongate member 110 has at least as many first apertures 130 as the number of fence panel rails onto which gate upright 100 will be installed. In certain other embodiments, tubular elongate member 110 has an identical number of first apertures 130 as the number of fence panel rails onto which gate upright 100 will be installed. According to embodiments of the present invention, first apertures 130 may be longitudinally aligned and positioned along the length of tubular elongate member 110 in any configuration. In certain embodiments, first apertures 130 may be longitudinally aligned and positioned along the length of tubular elongate member 110 such that they correspond to the relative positions of the fence panel rails onto which gate upright 100 will be installed, i.e., the spacing between first apertures 130 corresponds to the spacing between the fence panel rails. Referring to FIGS. 1A, 1B, and 1C, in certain embodiments a first aperture 130 may be situated proximal to the top end of tubular elongate member 110, another first aperture 130 may be situated proximal to the bottom end of tubular elongate member 110, and yet another first aperture 130 is situated intermediate to top and bottom first apertures 130 and proximal to first aperture 130 situated proximal to the top end of tubular elongate member 110. In certain embodiments, the distance between first aperture 130 situated proximal to the top end of tubular elongate member 110 and intermediate aperture 130 situated proximal thereto is approximately 4.875". In certain embodiments, the distance between the bottom end of tubular elongate member 110 and first aperture 130 situated proximal thereto is approximately 7.750".

Referring to FIGS. 1A, 1B, and 1C, bracket 120 is attached to an exterior surface of tubular elongate member 110 and comprises a pair of bracket arms 140. Each of bracket arms 140 are situated directly opposite the other with a first aperture 130 situated therebetween. Each bracket arm 140 comprises at least one second aperture 150 configured to accommodate a fastener for fastening an inserted fence panel rail to the bracket. Referring to FIGS. 1*a*, 1*b*, and 1*c*, bracket arms 140 are depicted therein as configured having two second apertures 150. However, in certain embodiments, each bracket arm 140 may each be configured to have a single second aperture 150. In certain other embodiments, each bracket arm 140 may each be configured to have more than two second apertures 150.

Figure 2A:
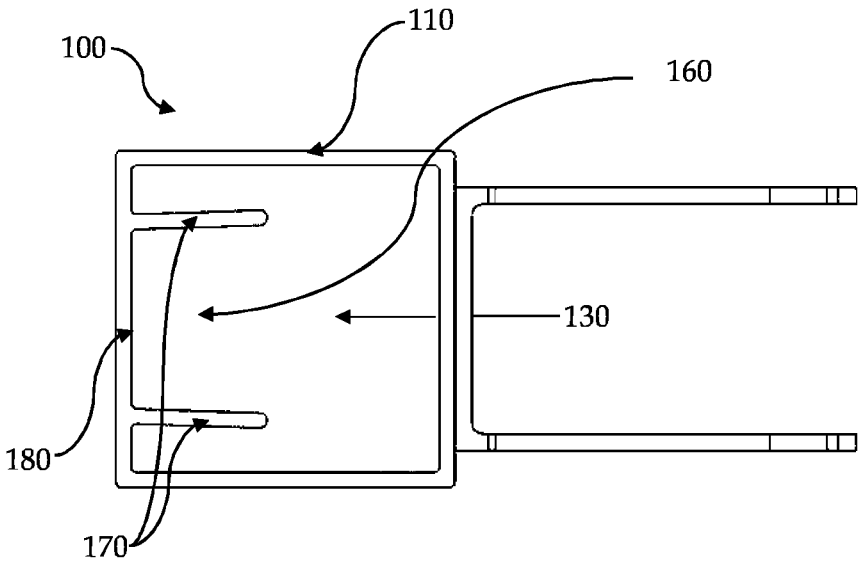
FIGS. 2A and 2B illustrate transverse cross sectional views of a gate upright according to embodiments of the present invention disclosed herein.
Figure 2B:
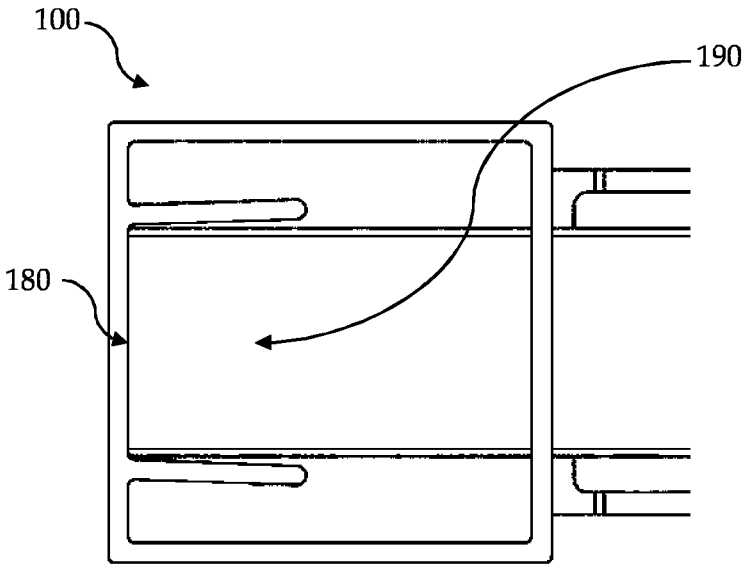

Referring to FIG. 2A, situated on and extending a length of an interior surface of tubular elongate member 110 is an elongate channel 160, which is configured to securely receive an end of an inserted fence panel rail such that its lateral and torsional movement is restricted when received therein. Elongate channel 160 is situated directly opposite first apertures 130. In certain embodiments, elongate channel 160 is defined by a pair of planes 170 extending longitudinally along an interior surface 180 tubular elongate member 110 and projecting inwardly into an interior space of tubular elongate member 110. As depicted in FIG. 2A, planes 170 may be angled away from each other to better promote secure receipt of a fence panel rail into elongate channel 160. Planes 170 may be angled away from each other to any desired configuration. In certain embodiments, each plane 170 is angled away from the other by 4.000° from parallel. In certain other embodiments, planes 170 may be configured parallel to each other. Referring to FIG. 2B, a fence panel rail end 190 inserted through first aperture 130 has been securely received into elongate channel 160 such that there is no gap between fence panel rail 190 and interior surface 180 of tubular elongate member 110.

Figure 3A:
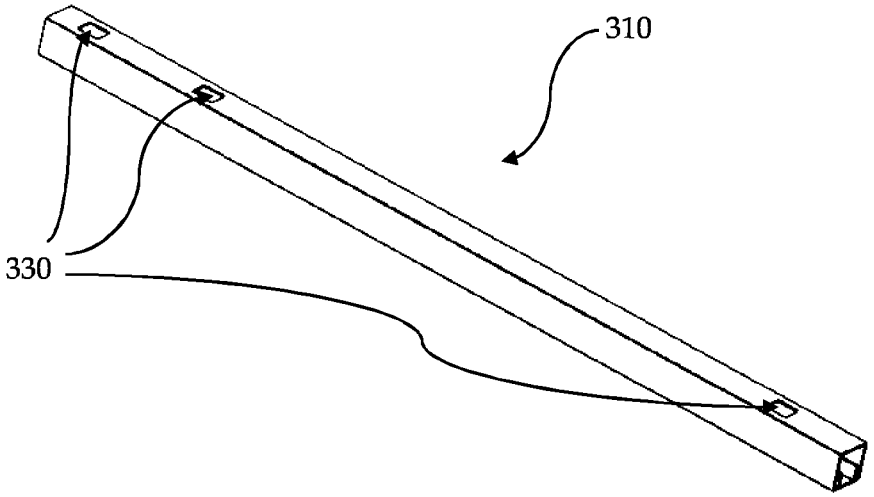
FIGS. 3A and 3B illustrate perspective views of a tubular elongate member and a bracket, respectively, according to embodiments of the present invention disclosed herein.
Figure 3B:
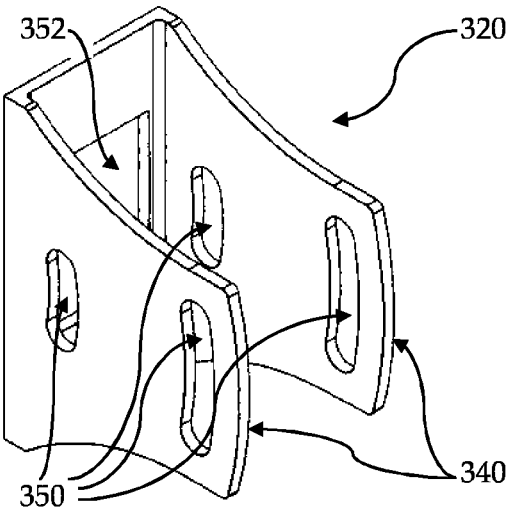

Gate uprights 100 of the rackable gate kits according to embodiments of the present invention may be fabricated according to any desired process known in the art. Referring to FIGS. 3A and 3B, both the tubular elongate member 310 and bracket 320 may be fabricated from extruded aluminum. However, in certain other embodiments, both the tubular elongate member 310 and bracket 320 may alternatively be fabricated from any desired material. Examples of such materials include, but are not limited to, solid aluminum, other metals and alloys, wood rubber, plastic, and/or other materials known in the art. In certain embodiments, tubular elongate member 310 and bracket 320 may be fabricated from powder coated aluminum. In certain embodiments, first apertures 330 of tubular elongate member 310 may be formed via routing. In certain other embodiments, second apertures 350, and a further aperture 352, in bracket 320, may be formed via routing. In certain embodiments, aperture 352 may be configured to have dimensions identical or larger than a first aperture 330. In certain embodiments, one or more brackets may be attached to a surface of tubular elongate member 310 such that aperture 352 is positioned directly over a first aperture 330 and bracket arms 340 extend outwardly from the surface of tubular elongate member 310. The one or more brackets 320 may be attached to a surface of tubular elongate member 310 by any means known in the art, e.g., by welding. In certain embodiments, a single bracket 320 is attached to a surface of tubular elongate member 310 as described in the foregoing manner. In certain other embodiments, a single bracket 320 is attached to a surface of tubular elongate member 310 as described in the foregoing manner such that aperture 352 is positioned directly over an intermediate first aperture 330 so as to result in a gate upright 100 in accordance with embodiments of the present invention, as depicted in FIGS. 1A, 1B, and 1C.

Figure 4:
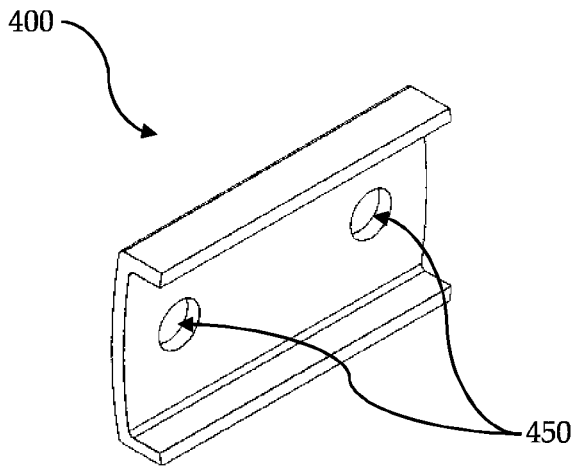
FIG. 4 illustrates a perspective view of a rail gripper according to embodiments of the present invention disclosed herein.

In addition to a pair of gate uprights 100, the rackable gate kits according to embodiments of the present invention may further comprise one or more additional components. In certain embodiments, such components may be selected from group consisting of rail grippers, hinges, gate stops, latches, fasteners, U-channel blocks, and post tops, or any combination thereof. Such further components may be of any type, design, style, and/or configuration known in the art. Examples the hinges include, but are not limited to, butterfly hinges, spring hinges, and combinations thereof. In certain embodiments, the latches may be gravity latches. In certain embodiments, the post tops may have a pyramidal configuration. Examples of fasteners include, but are not limited to, those configured to secure a fence panel rail to bracket 120, such as bolt, washer, and nut (e.g. acorn nut) systems, and those configured to secure a fence panel rail to an interior surface of tubular elongate member 110, e.g. screws. Referring to FIG. 4, rail gripper 400, which may be a further component in the rackable gate kits according to embodiments of the present invention, is configured to be positioned between a side of a fence panel rail and a bracket arm 140 prior to securing bracket arms 140 to the fence panel rail with one or more fasteners. In certain embodiments, rail gripper 400 may be configured with one or more predrilled holes 450 that positionally correspond to the one or more second apertures 150 when installed between a fence panel rail and a bracket arm 140. When thus installed, predrilled holes 450 may, if necessary, be used as a guide to drill one or more holes through a fence panel rail in order to facilitate installation of one or more fasteners therethrough. In certain embodiments, the rackable gate kits according to embodiments of the present invention may comprise a pair of rail grippers 400 so that each of the pair of rail grippers 400 can be positioned between opposing sides of a fence panel rail and a corresponding bracket arm 140 prior to fastening. In certain other embodiments, the rackable gate kits may comprise two pairs of rail grippers 400. In yet certain other embodiments, the rackable gate kits may comprise as many pairs of rail grippers 400 as there are brackets 120 on the gate uprights 100 present in the kit.

Another aspect of the present invention are methods of assembling a gate. In accordance with embodiments of the present invention, these methods comprise the following six steps.

Figure 5A:
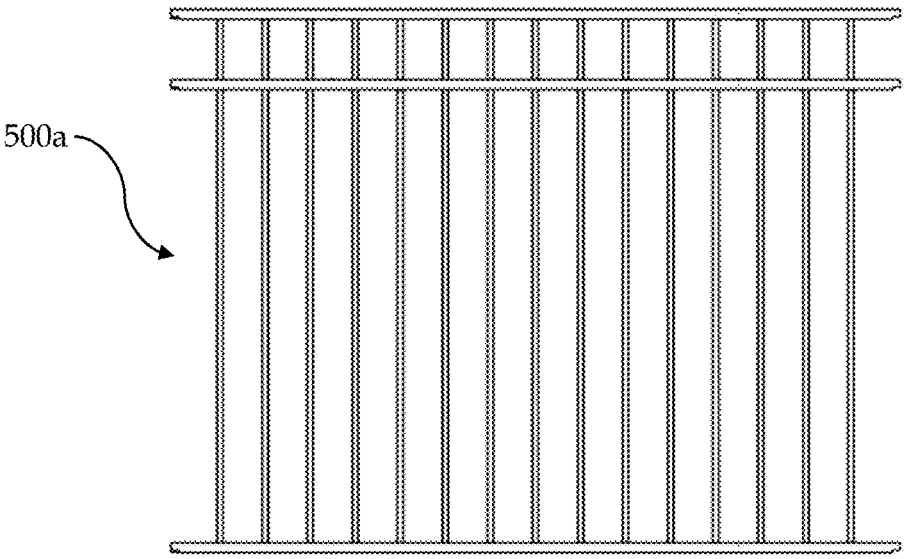
FIGS. 5A and 5B illustrate front elevation views of straight and racked fence panels, respectively, according to embodiments of the present invention disclosed herein.
Figure 5B:
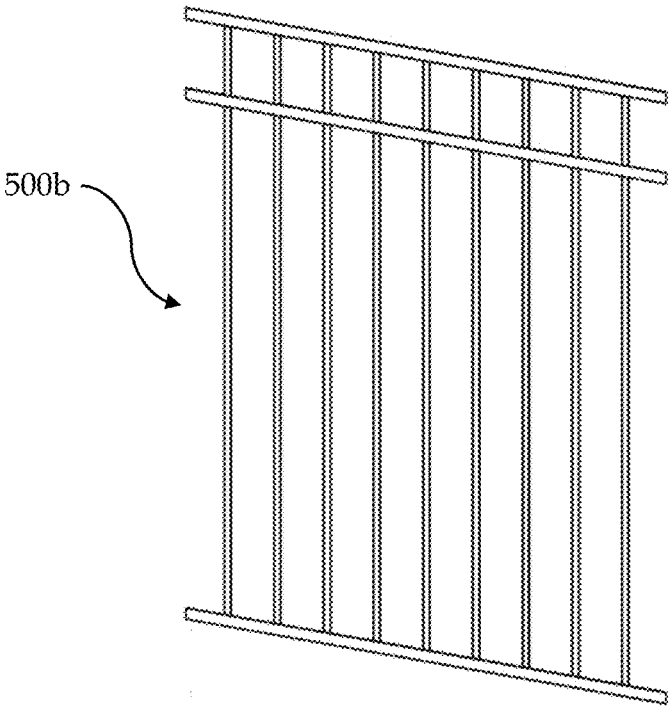

In a step one, a fence panel comprising a plurality of vertical pickets and a plurality of elongate rails extending transverse to the vertical pickets is provided. Each elongate rail has a first end and a second end opposite the first end. In accordance with embodiments of the present invention, such fence panels may be any desired dimension. In certain embodiments, the fence panel may be up to 60' wide. In certain other embodiments, the fence panel may be up to 54" high. In certain embodiments, the fence panel may be straight. FIG. 5A illustrates a front elevation view of a straight fence panel 500*a* for use in embodiments in accordance with the present invention. In certain embodiments, the fence panel may be racked and/or rackable. FIG. 5B illustrates a front elevation view of a racked fence panel 500*b* for use in embodiments in accordance with the present invention. Examples of such racked and/or rackable fence panels that may be used in embodiments in accordance with the present invention include those disclosed in U.S. Pat. Nos. 8,413,332 B2, 8,413,965 B2, and 9,551,164 B2, the disclosures of each of which is incorporated herein by reference in its entirety for all useful purposes. In those embodiments where the fence panel of step one is racked, the fence panel may be racked upwardly or downwardly to any desired angle. In certain embodiments, the upward or downward racking angle of the fence panel may be any angle up to a maximum of 10°. In certain other embodiments, the upward or downward racking angle of the fence panel may be any angle up to a maximum of 11°. In certain embodiments, the fence panel may, prior to step one, be cut down to fit a particular gate opening in a fence. In certain embodiments where the gate will be racked, the fence panel may be racked to the desired angle prior to being cut down.

In a step two, a rackable gate kit according to embodiments of the present invention is provided. Each gate upright 100 of the pair provided therein comprises at least as many first apertures 130 as the number of elongate rails of the fence panel provided in step one. Furthermore, the spacing between the first apertures 130 corresponds to the spacing between the elongate rails.

Figure 6A:
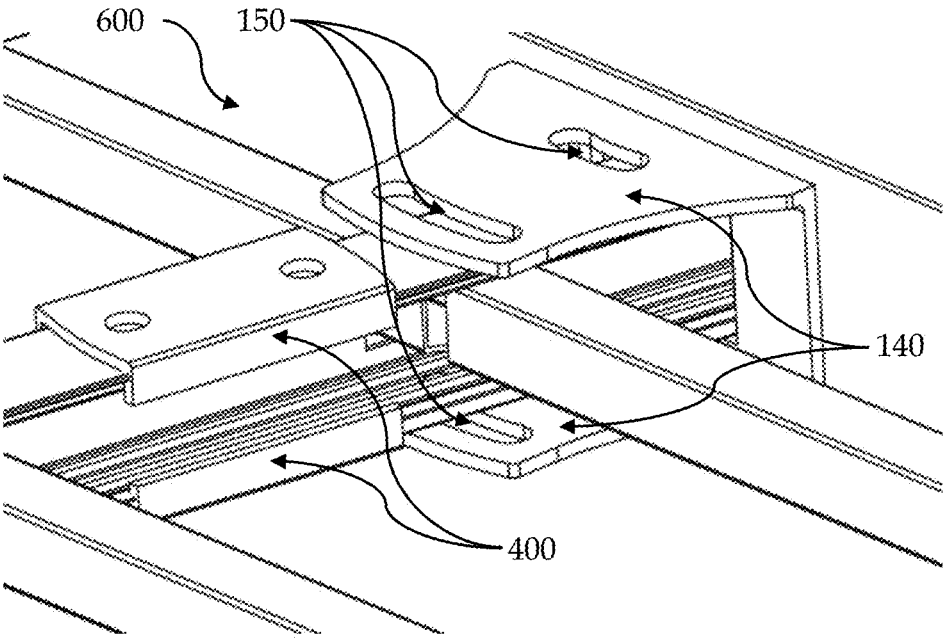
FIGS. 6A and 6B illustrate partial profile views of an assembly of a gate upright installed onto elongate rails of a fence panel according to embodiments of the present invention as disclosed herein.
Figure 6B:
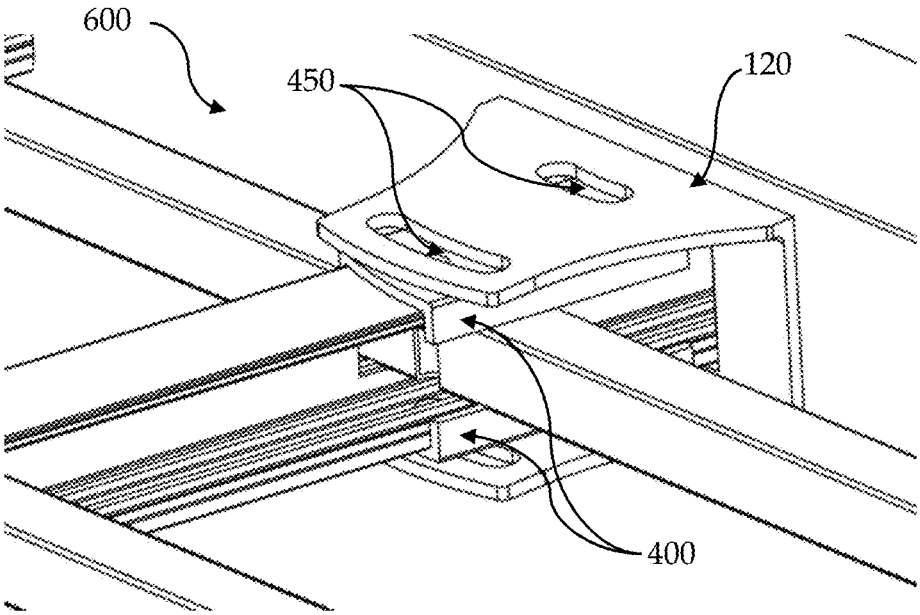

In a step three, a first gate upright 100 from the rackable gate kit is installed onto the first ends 190 of the elongate rails by inserting each first end 190 through a corresponding first aperture 130 such that each first end 190 is securely received into the elongate channel 160 of the first gate upright 100, as depicted in FIG. 2B. In certain embodiments where the gate will be racked, the fence panel may be racked to the desired angle before, during, or after step three is performed. In certain embodiments, the racked fence panel may be temporarily secured at a desired racked angle by clamping the gate upright and nearest vertical picket together in order to prevent the panel from moving during subsequent steps. In certain embodiments, a pair of rail grippers 400 may be installed after step three but prior to step four for the purpose of augmenting the grip of bracket 120 on an elongate rail positioned therethrough. FIGS. 6A and 6B illustrate partial profile views of an assembly 600 of a gate upright 100 installed onto the elongate rails of a fence panel undergoing installation of rail grippers 400. Referring to FIGS. 6A and 6B, rail grippers 400 may be placed on opposing sides of an elongate rail and then installed by sliding each rail gripper 400 between the elongate rail and a bracket arm 120 proximate thereto. In certain embodiments, each rail gripper 400 may be positioned such any predrilled holes 450 are aligned with the second apertures 150 of bracket arms 120, which may then be used as guides to drill corresponding holes through the elongate rail to allow for installation of fasteners therethrough.

Figure 7A:
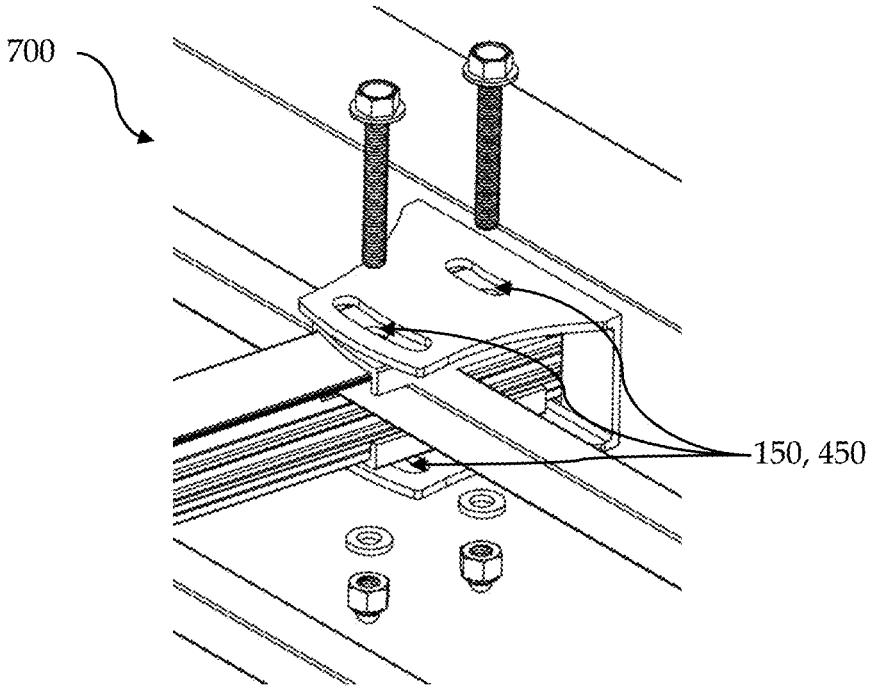
FIGS. 7A and 7B illustrate partial profile views of an assembly of a gate upright installed onto elongate rails of a fence panel according to embodiments of the present invention as disclosed herein.
Figure 7B:
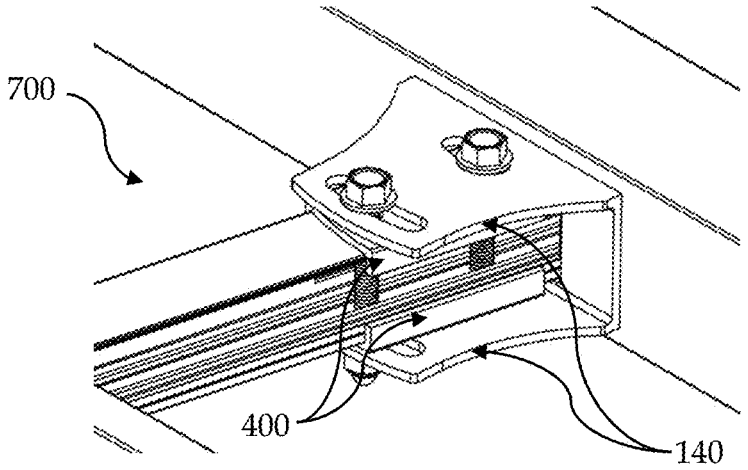

In a step four, the first gate upright 100 may be secured to the fence panel by fastening the pair of bracket arms 140 of first gate upright 100 to an elongate rail situated therebetween with at least one fastener traversing one or more second apertures 150 of each bracket arm 140 and the fence panel rail. FIGS. 7A and 7B illustrate partial profile views of an assembly 700 of gate upright 100 installed onto the elongate rails of a fence panel undergoing installation of fasteners. Referring to FIGS. 7A and 7B, in certain embodiments first gate upright 100 may be secured to the fence panel by installing bolt/washer/acorn nut fastener systems through the second apertures 150 of bracket arms 140, the predrilled holes 450 of rail grippers 400, and the corresponding holes predrilled through the elongate rail.

In a step five, step three is essentially repeated to the other end of the fence gate panel. The second gate upright 100 from the rackable gate kit is installed onto the second ends 190 of the elongate rails by inserting each first end 190 through a corresponding first aperture 130 such that each first end 190 is securely received into the elongate channel 160 of the first gate upright 100, as depicted in FIG. 2B. As in step three, a pair of rail grippers 400 may be installed after step five but prior to step six for the purpose of augmenting the grip of bracket 120 on an elongate rail positioned therethrough, as depicted in FIGS. 6A and 6B.

In a step six, step four is essentially repeated to the second gate upright 100 installed onto second ends 190 from step five. The second gate upright 100 may be secured to the fence panel by fastening the pair of bracket arms 140 of the second gate upright 100 to an elongate rail situated therebetween with a fastener traversing a second aperture 150 of each bracket arm 140 and the fence panel rail. Referring to FIGS. 7A and 7B, in certain embodiments second gate upright 100 may be secured to the fence panel by installing bolt/washer/acorn nut fastener systems through the second apertures 150 of bracket arms 140, the predrilled holes 450 of rail grippers 400, and the corresponding holes predrilled through the elongate rail.

Figure 8A:
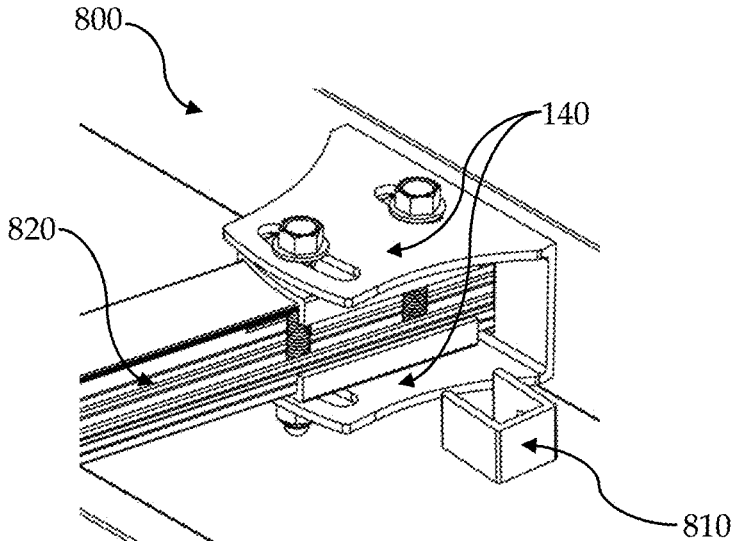
FIGS. 8A and 8B illustrate partial profile views of assembly of a gate upright installed onto elongate rails of a fence panel according to embodiments of the present invention as disclosed herein.
Figure 8B:
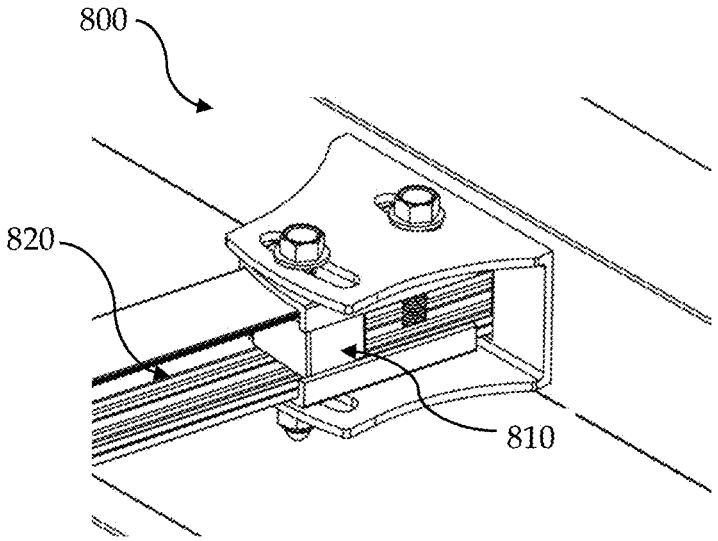

In certain embodiments, the configuration of the elongate rails of the fence panel comprises hollow, inverted U-channels. In such embodiments, tightening down of the installed fastener (e.g., the bolt, washer, and nut) may result in deformation of the elongate rail and/or bracket arms 140. While this may be avoided in certain embodiments where a vertical picket of the fence panel is located between bracket arms 140, in certain other embodiments such deformation may be prevented by installation of a U-channel block. FIGS. 8A and 8B illustrate partial profile views of an assembly 800 of gate upright 100 installed onto the elongate rails of a fence panel undergoing installation of a U-channel block. Referring to FIGS. 8A and 8B, in certain embodiments a U-channel block 810 may be installed into the inverted U-channel 820 of the elongate rail located between bracket arms 140 prior to tightening down the fastener. Once U-channel block 810 is installed, the fastener may then be tightened down.

Figure 9:
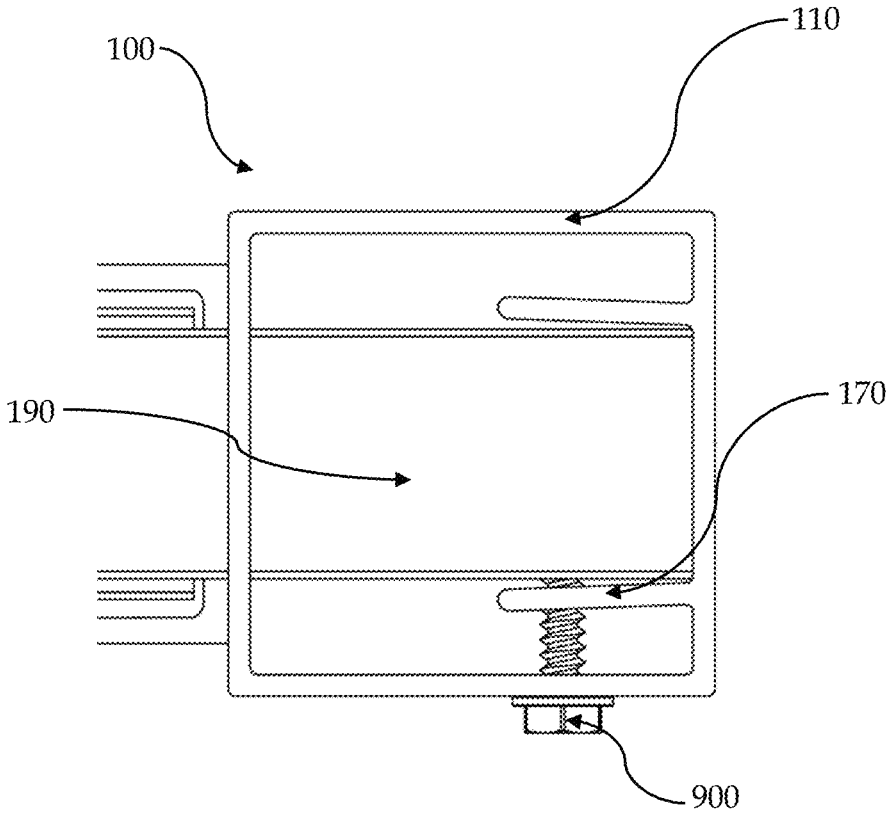
FIG. 9 illustrates a transverse cross sectional view of a gate upright according to embodiments of the present invention as disclosed herein.

The method of assembling a gate in accordance with embodiments of the present invention may further comprise the step of securing each of the plurality of elongate rails to an interior surface of tubular elongate member 110 of each gate upright 100 by installing a fastener through each tubular elongate member 110 and into each elongate rail securely received into elongate channel 160. FIG. 9 illustrates a transverse cross sectional view of a gate upright according to embodiments of the present invention, wherein a fence panel rail end inserted through a first aperture has been securely received into the elongate channel. Referring to FIG. 9, fastener (e.g., a hex head screw) 900 can be installed through tubular elongate member 110, through plane 170, and into elongate rail 190. However, in certain other embodiments, the fastener 900 may alternatively be installed through tubular elongate member 110 and directly into elongate rail 190. In certain embodiments, fastener 900 is installed ⅝" from a longitudinal edge of tubular elongate member 110. In certain embodiments, the holes for installation of fasteners 900 through tubular elongate member 110 is predrilled.

Figure 10A:
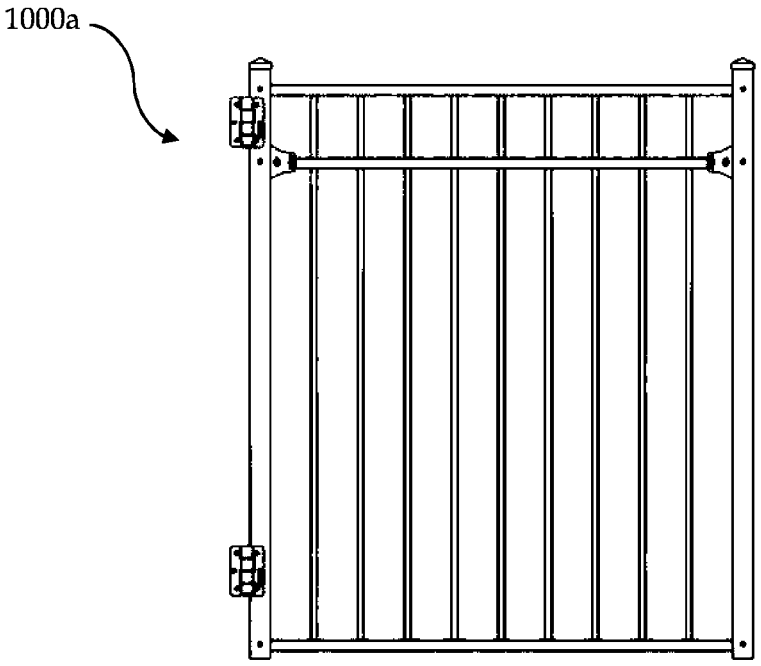
FIGS. 10A and 10B illustrate front elevation views of straight and racked gates, respectively, according to embodiments of the present invention as disclosed herein.
Figure 10B:
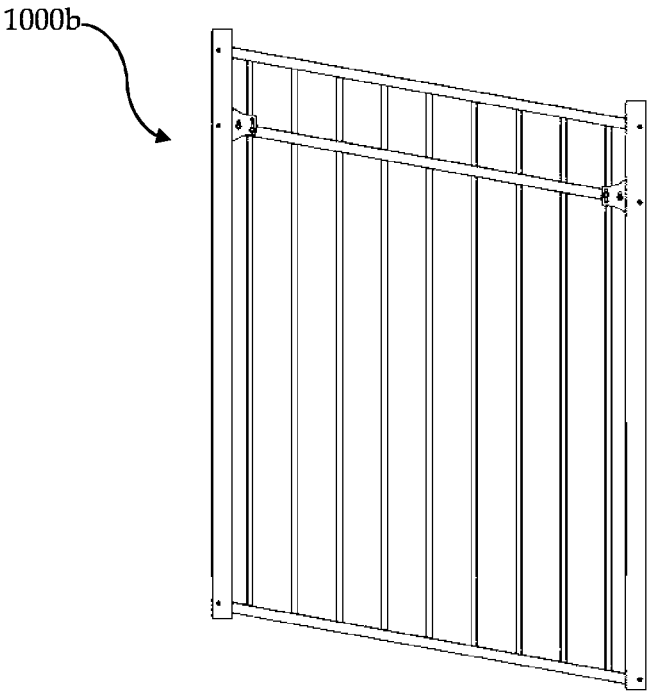

Another aspect of the present invention are gates assembled from the racking gate kits and according to the methods in accordance with embodiments of the present invention. FIG. 10A illustrates a front elevation view of a straight gate 1000*a* assembled from the racking gate kits and according to the methods in accordance with embodiments of the present invention. FIG. 10B illustrates a front elevation view of a racked gate 1000*b* assembled from the racking gate kits and according to the methods in accordance with embodiments of the present invention.

The present invention, in various embodiments, configurations, and aspects, includes components, methods, processes, systems, and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments and that the list is not intended to represent a closed list exclusive of further embodiments. Such wording may include "e.g.," "etc.," "such as," "for example," "and so forth," "and the like," etc., and other wording as will be apparent from the surrounding context.

What is claimed is:

1. A rackable gate kit, the rackable gate kit comprising a pair of gate uprights and a fence panel rail, wherein the pair of gate uprights define a plane for a gate assembled from the rackable gate kit, wherein each gate upright comprises:

a tubular elongate member, the tubular elongate member comprising:

a plurality of first apertures in alignment along a length of the tubular elongate member, wherein each of the plurality of first apertures is configured to accept insertion of the fence panel rail therethrough and into an interior space of the tubular elongate member when the fence panel rail is connected to the tubular elongate member; and an elongate channel situated on and extending a length of an interior surface of the tubular elongate member, wherein the elongate channel is situated directly opposite the plurality of first apertures and configured to securely receive an end of the fence panel rail such that lateral and torsional movement of the end of the fence panel rail is restricted with respect to the tubular elongate member when received therein; and a bracket comprising a pair of bracket arms extending from a base plate, the pair of bracket arms attached to, and extending from, an exterior surface of the tubular elongate member and providing an axis of pivoting attachment for the fence panel rail, the axis being perpendicular to the plane of the gate, wherein each of the pair of bracket arms is situated directly opposite each other with one of the plurality of first apertures therebetween, the base plate comprises a base plate aperture formed therein such that the fence panel rail extends through both the respective first aperture of the tubular elongate member and the base plate aperture, and wherein each of the pair of bracket arms comprises at least one second aperture configured to accommodate a fastener for fixedly attaching the fence panel rail to the bracket, wherein the bracket is configured to restrict vertical movement of the fence panel rail along the tubular elongate member within the plane of the gate, and wherein the bracket is configured to restrict lateral movement of the fence panel rail perpendicular to the plane of the gate, and wherein the bracket is configured to permit rotational movement of the fence panel rail about the axis within the plane of the gate to thereby provide the assembled gate with a straight configuration or a racked configuration.

2. The rackable gate kit of claim 1, wherein each of the gate uprights are formed from extruded aluminum.

3. The rackable gate kit of claim 1, wherein a horizontal cross-sectional shape of the tubular elongate member is square.

4. The rackable gate kit of claim 1, wherein each first aperture is formed via routing.

5. The rackable gate kit of claim 1, wherein each first aperture is square or rectangular in shape.

6. The rackable gate kit of claim 1, wherein each first aperture is further configured to accommodate an upwardly and/or downwardly racked fence panel rail.

7. The rackable gate kit of claim 1, wherein each tubular elongate member comprises three first apertures, wherein a top first aperture is situated proximal to a top end of said tubular elongate member, a bottom first aperture is situated proximal to a bottom end of said tubular elongate member, and an intermediate first aperture is situated intermediate to said top and bottom first apertures.

8. The rackable gate kit of claim 1, wherein the elongate channel is defined by a pair of planes extending longitudinally along said interior surface of the tubular elongate member and projecting inwardly into said interior space of the tubular elongate member.

9. The rackable gate kit of claim 8, wherein each of said pair of planes is angled away from the other.

10. The rackable gate kit of claim 1, wherein each bracket arm comprises two second apertures each configured to accommodate a fastener for fastening a fence panel rail to said bracket.

11. The rackable gate kit of claim 1, wherein each tubular elongate member further comprises a plurality of pre-drilled holes, wherein each pre-drilled hole is situated and configured to accommodate a fastener for securing a fence panel rail to said tubular elongate member.

12. The rackable gate kit of claim 1, wherein the kit further comprises one or more additional components selected from a group consisting of: rail grippers, hinges, gate stops, latches, fasteners configured to secure a fence panel rail to said bracket, fasteners configured to secure a fence panel rail to said tubular elongate member, U-channel blocks, and post tops.

13. A method of assembling a gate, the method comprising the steps of:

a) providing a fence panel comprising a plurality of vertical pickets and a plurality of elongate rails extending transverse to said vertical pickets, each rail having a first end and a second end opposite the first end;

b) providing the rackable gate kit according to claim 1, wherein each gate upright comprises at least as many of said first apertures as said plurality of elongate rails, and wherein spacing between said plurality of first apertures correspond to spacing between said plurality of elongate rails;

c) installing a first gate upright onto each of the first ends of the plurality of elongate rails by inserting each elongate rail through a corresponding first aperture of said first gate upright such that each first end is securely received into the elongate channel of said first gate upright;

d) securing the first gate upright to said fence panel by fastening the pair of bracket arms of said first gate upright to an elongate rail situated therebetween with a fastener traversing the at least one second aperture of each bracket arm and said elongate rail;

e) installing a second gate upright onto each of the second ends of the plurality of elongate rails by inserting each elongate rail through a corresponding first aperture of said second gate upright such that each second end is securely received into the elongate channel of said second gate upright; and f) securing the second gate upright to said fence panel by fastening the pair of bracket arms of said second gate upright to an elongate rail situated therebetween with a fastener traversing the at least one second aperture of each bracket arm and said elongate rail.

14. The method of claim 13, further comprising the step of installing a rail gripper between each bracket arm and the elongate rail situated therebetween prior to fastening the pair of bracket arms to the elongate rail.

15. The method of claim 13, further comprising the step of securing each of the plurality of elongate rails to the tubular elongate member of each gate upright by installing a fastener through each tubular elongate member and into each elongate rail.

16. The method of claim 13, further comprising the step of cutting the fence panel to fit a gate opening prior to installation of the pair of gate uprights thereon.

17. The method of claim 13, wherein the fence panel is straight.

18. The method of claim 13, wherein the fence panel is racked.

19. A gate assembled according to the method of claim 13.

* * * * *